US010164329B2

(12) United States Patent
Shamblin et al.

(10) Patent No.: US 10,164,329 B2
(45) Date of Patent: Dec. 25, 2018

(54) WIDEBAND MIMO ARRAY WITH LOW PASSIVE INTERMODULATION ATTRIBUTES

(71) Applicant: Ethertronics, Inc., San Diego, CA (US)

(72) Inventors: John Shamblin, San Diego, CA (US); Jeffrey Shamblin, San Marcos, CA (US); Laurent Desclos, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 15/150,314

(22) Filed: May 9, 2016

(65) Prior Publication Data

US 2017/0125912 A1 May 4, 2017

Related U.S. Application Data

(60) Provisional application No. 62/159,090, filed on May 8, 2015.

(51) Int. Cl.

| | |
|---|---|
| ***H01Q 5/30*** | (2015.01) |
| ***H01Q 1/48*** | (2006.01) |
| ***H01Q 9/36*** | (2006.01) |
| ***H01Q 21/24*** | (2006.01) |
| ***H01Q 21/28*** | (2006.01) |

(52) U.S. Cl.

CPC ..... *H01Q 1/48* (2013.01); *H01Q 9/36* (2013.01); *H01Q 21/24* (2013.01); *H01Q 21/28* (2013.01)

(58) Field of Classification Search

CPC H01Q 13/10; H01Q 1/48; H01Q 9/30; H01Q 9/285; H01Q 5/30

USPC ..... 343/795, 767, 725

See application file for complete search history.

(56) References Cited

U.S. PATENT DOCUMENTS

| | | | | |
|---|---|---|---|---|
| 7,724,717 | B2 | 5/2010 | Porras et al. | |
| 7,913,022 | B1 | 3/2011 | Baxter | |
| 8,610,626 | B2 * | 12/2013 | Chang | H01Q 1/2258 343/700 MS |
| 9,263,787 | B2 | 2/2016 | Dupuy et al. | |
| 9,270,374 | B2 | 2/2016 | Cune et al. | |
| 2011/0057852 | A1 * | 3/2011 | Holland | H01Q 9/28 343/795 |
| 2014/0266962 | A1 | 9/2014 | Dupuy et al. | |
| 2015/0162665 | A1 * | 6/2015 | Boryssenko | H01Q 1/48 343/797 |

* cited by examiner

*Primary Examiner* — Dameon E Levi
*Assistant Examiner* — Hasan Islam
(74) *Attorney, Agent, or Firm* — Dority & Manning, P.A.

(57) ABSTRACT

A wideband array capable of MIMO operation and possessing low Passive Intermodulation (PIM) characteristics is described for use in Distributed Antenna Systems (DAS) and other applications which require low PIM levels. The antenna can be configured to provide a narrow radiated beamwidth across multiple frequency bands and can support high power levels. A novel antenna design is implemented to populate the array configuration, wherein both fed and counterpoise elements are isolated from the ground plane to provide low PIM performance, while maintaining constant beamwidth across wide frequency ranges.

20 Claims, 8 Drawing Sheets

WIDEBAND MIMO ARRAY WITH LOW PASSIVE INTERMODULATION ATTRIBUTES

CROSS-REFERENCE TO RELATED APPLICATIONS

This application claims benefit of priority with U.S. Provisional Ser. No. 62/159,090, filed May 8, 2015; the contents of which are hereby incorporated by reference.

FIELD OF INVENTION

The present invention relates generally to the field of wireless communication. In particular, the present invention relates to distributed antenna systems capable of robust multi-band operation for use in wireless communications.

BACKGROUND OF THE INVENTION

Continued adoption of cellular systems for data transfer as well as voice communications along with introduction of new mobile communications devices such as Tablet devices make cellular coverage in urban environments a priority. In particular, improving cellular coverage in public venues where large a number of cellular users are present is important to provide a seamless user experience in the mobile communication arena. Distributed antenna systems (DAS) are being installed in sports arenas, convention centers and other public areas and are used to provide stronger RF signals to improve the communication link for cellular and data services. These DAS systems are crucial to maintaining capacity of cellular systems as users increase the amount of data that is uploaded and downloaded.

Initial DAS antenna systems were only required to operate over a few frequency bands, making the antenna design process easier. As the communications industry has moved from 2G to 3G cellular systems, frequency band count for DAS antennas has increased. With the advent of 4G communication systems such as Long Term Evolution (LTE), additional frequency bands are required from a DAS antenna system which increases the difficulty in terms of antenna design. LTE also brings a two antenna requirement needed to implement a Multiple Input Multiple Output (MIMO) antenna system.

As the density of mobile communication users increases in public spaces such as sports arenas and convention centers, and as more users access high data rate features such as file sharing and video downloads the signal to noise characteristics and RF signal levels of the cellular signals indoors become more important parameters. To maintain low noise floors in communication systems a parameter that is important to address in the antenna design is Passive Intermodulation (PIM). PIM products are generated when two RF signals at different frequencies are injected into an antenna port; the antenna, though being a passive device, can generate spurious responses due to "natural diode" junctions in the antenna. These natural diode junctions can be formed at the junction of two metal surfaces where the metals are dissimilar. Corrosion and oxidation at these junctions can also cause spurious frequency components due to mixing of the two RF signals. Proper antenna design and material selection is important to meet stringent, low PIM requirements. As PIM components increase, these spurious frequency components add to the noise level, which in turn results in reduced signal to noise ratio of the communication system. This will result in reduced data rates for users.

Low PIM requirements can be difficult to obtain in high gain antenna applications due to the large number of antenna elements typically used to form an array. Arraying multiple antenna elements together is a common technique used to generate higher gain antennas. The multiple connection points required when arraying multiple antennas together provide more opportunities for PIM to be produced; these connection points can be antenna element to ground plane connections, connector to ground plane interfaces, and coaxial transmission line interfaces.

Initially, low gain antennas were used implement DAS systems in public venues. To maximize capacity as the number of mobile users increased at public venues, higher gain antennas were used to replace the low gain, near omni-directional antennas. These higher gain antennas are typically a linear array of elements which provide a narrow or reduced beamwidth in one plane while maintaining a broad or wide beamwidth in the other principal plane passing through the main lobe of the radiation pattern. As the density of mobile communication users increases further there is a need to move from antennas that have a narrow beamwidth in one plane to narrow beamwidth in both principal planes of the radiation pattern. This move to full 2D arrays will bring more complexity to the arraying process as well as complexity in regards to maintaining PIM performance.

DESCRIPTION OF THE INVENTION

This patent describes a wideband antenna array capable of efficient transmission and reception in multiple frequency bands while maintaining low passive intermodulation (PIM) performance. Two arrays are co-located to provide a MIMO (Multiple Input Multiple Output) antenna solution. When multiple frequency bands are required to be serviced across lower cellular bands (700 to 960 MHz) and upper cellular frequency bands (1710 to 2700 MHz) a pair of arrays can be implemented for each frequency range, resulting in four arrays co-located to service lower and upper frequency bands for MIMO operation.

In one aspect of the present invention, a two conductor antenna is designed to cover a wide frequency range and provide a constant beamwidth across the frequency range. The two conductor antenna is designed to operate in proximity to a ground plane. This two conductor antenna can be used to populate an array that covers the wide frequency range. The antenna is designed such that the first conductor which is connected to the transmission line that feeds the antenna is completely isolated from the ground plane. The second conductor that acts as a counterpoise or "ground arm" of the antenna is also completely isolated from the ground plane. Portions of each conductor are positioned in close proximity to the ground plane, with these portions of each conductor dimensioned and spaced to form a capacitively coupled region when placed in proximity to the ground plane. This capacitively coupled region provides a region of low impedance at the frequency range of operation of the antenna. PIM products are reduced or avoided using this type design due to a lack of conductor to conductor interfaces, where two conductors would normally come into contact.

In one embodiment of the invention, the first conductor of a two conductor antenna contains a portion of conductor that is positioned in close proximity to the second conductor. The first conductor can be positioned in parallel to the second conductor and aligned within the same plane as the second conductor to form a region between the first and second conductors where portions of each conductor form a coupling region. This coupling region can be altered by varying the distance between the first and second conductor and the length of each conductor. This coupling region can be used to alter or optimize the impedance match of the antenna element at the frequency range of interest. This coupling region provides a method of impedance matching the antenna while maintaining low PIM attributes due to the lack of conductor on conductor contact regions.

In another embodiment of the invention, a first conductor is positioned in proximity to a second conductor, with the second conductor acting as a counterpoise to the first conductor. The first and second conductors are positioned next to a ground plane. A portion of the first conductor at the top of the conductor is oriented predominantly parallel to the ground plane. This portion of conductor is dimensioned to decrease the frequency of operation of the resultant antenna formed by the first and second conductors positioned in proximity to the ground plane. A portion of the second conductor can also be oriented and positioned predominantly parallel to the ground plane to decrease the frequency response of the resultant antenna.

In another embodiment of the invention, a first conductor is positioned in proximity to a second conductor, with the second conductor acting as a counterpoise to the first conductor. A third conductor is positioned in proximity to the second conductor, with the third conductor oriented predominantly perpendicular to the first conductor. All three conductors are positioned close to a ground plane. Both the first and third conductors are fed from separate transmission lines, resulting in a pair of driven antennas that utilize the same counterpoise conductor. The isolation between the two antennas is optimized by proper selection of the angle formed by the first and third conductors. The impedance match of the two antennas can be optimized by altering the spacing between the driven conductor, the first or third conductor, and the second conductor. All three conductors are isolated from the ground plane to provide low PIM attributes.

In another embodiment of the invention, the conductor used as a counterpoise is wedge shaped to better facilitate coupling to by multiple conductors. When the counterpoise conductor is wedge shaped with a predominantly 90 degree included angle, then two driven conductors can be coupled to the wedge shaped counterpoise conductor, and each driven conductor will couple to a planar section of the wedge shaped conductor that can be oriented in the same plane as a planar driven conductor.

In another embodiment of the invention, a first planar conductor is positioned in proximity to a second conductor, with the second conductor acting as a counterpoise for the first conductor. Both first and second conductors are positioned close to a ground plane. A transmission line is connected to a corner of the first planar conductor to provide a driven antenna. Portions of the first planar conductor are removed close to the ground plane to form a slot region between the transmission line and the end of the first planar conductor. At the end of the first planar conductor opposite from the transmission line a portion of the first conductor is positioned in proximity to the ground plane to form a region where the first conductor couples to the ground plane. The resultant slot region formed between the transmission line and the end of the first planar conductor can be altered in length and width to adjust the frequency response of the resulting antenna.

In another embodiment of the invention, when very wide bandwidth is required from the antenna a first planar conductor is positioned in proximity to a second conductor, with the first and second conductors overlapping each other. The overlap region can be used to alter the impedance properties of the antenna and the overlap region can vary along one or multiple edges of the planar first and second conductors. The second conductor acting as a counterpoise for the first conductor. Both first and second conductors are positioned close to a ground plane. A transmission line is connected to a corner of the first planar conductor to provide a driven antenna. Portions of the first planar conductor are removed close to the ground plane to form a slot region between the transmission line and the end of the first planar conductor. At the end of the first planar conductor opposite from the transmission line a portion of the first conductor is positioned in proximity to the ground plane to form a region where the first conductor couples to the ground plane. The resultant slot region formed between the transmission line and the end of the first planar conductor can be altered in length and width to adjust the frequency response of the resulting antenna.

The previous embodiment can be altered to provide a second antenna integrated into the first antenna by adding an additional pair of conductors, conductors three and four. Conductor three can be fed with a transmission line similar to the previous embodiment and conductor four can be connected to conductor two such that conductors two and four are now a single counterpoise for a two antenna assembly. If conductor four is connected to conductor two at a perpendicular orientation and if conductor three is parallel to conductor four then the two antennas formed by the four conductors will provide dual polarization capability with the two polarizations being perpendicular to each other.

Another embodiment of this invention relates to the transmission line configuration used to feed the previously described embodiments. The ground conductor of the transmission line used to feed an antenna can be capacitively coupled to the ground plane that the antenna is attached to eliminate the physical contact between conductors. Likewise the center conductor of the transmission line can be capacitively coupled to the antenna element. When implemented on some previous embodiments the result is an antenna and transmission line assembly where there are no conductor to conductor (metal to metal) contacts. This configuration will provide for improved PIM performance.

In another embodiment of the invention multiple antennas as previously described are combined on a single ground plane to form an array. A transmission line feed network is used along with combiners to feed the multi-element array. The entire array and feed network can be assembled without conductor on conductor contact, allowing for improved PIM performance from the array. Utilizing the pair of perpendicular antenna elements as previously described will result in a pair of arrays co-located on the same ground plane, with two combining feed networks feeding the two arrays. Dual polarization performance will result from the co-located arrays.

Now turning to the drawings, FIG. 1 illustrates four co-located arrays integrated onto a single ground plane. Both low and high band arrays are shown, with each array having dual polarization capability.

FIG. 2 illustrates an antenna designed for use in an array. This antenna has a planar element with a top loaded section, with this planar element positioned next to a wedge shaped counterpoise which acts a as a ground section. Both the planar element and the wedge shaped counterpoise are capacitively coupled to the ground plane through bent conductor sections formed into each element. A coupling region is formed between the element and the wedge conductor. A portion of the element has a slot region formed by the bottom of the element and the ground plane, with this slot region dimensioned to alter the frequency response of the antenna.

FIG. 3 illustrates an antenna designed for use in an array where two antenna elements are positioned next to a common wedge shaped counterpoise. Each antenna has a planar element with a top loaded section. Both planar elements and the wedge shaped counterpoise are capacitively coupled to the ground plane through bent conductor sections formed into each element. A coupling region is formed between each element and the wedge conductor. A portion of the elements has a slot region formed by the bottom of the element and the ground plane, with this slot region dimensioned to alter the frequency response of the antenna.

FIG. 4 illustrates an antenna topology that will provide additional bandwidth while maintaining a constant beamwidth across the frequency band of interest. This two antenna assembly will provide orthogonal polarizations and uses a common ground or counterpoise structure. Two coupling sections are designed into each antenna element to aid the impedance matching process. Both antenna elements and the common counterpoise are capacitively coupled to the ground plane through bent conductor sections formed into each element. A coupling region is formed between each element and the counterpoise by overlapping the elements. A portion of the elements has a slot region formed by the bottom of the element and the ground plane, with this slot region dimensioned to alter the frequency response of the antenna.

Figure 1:
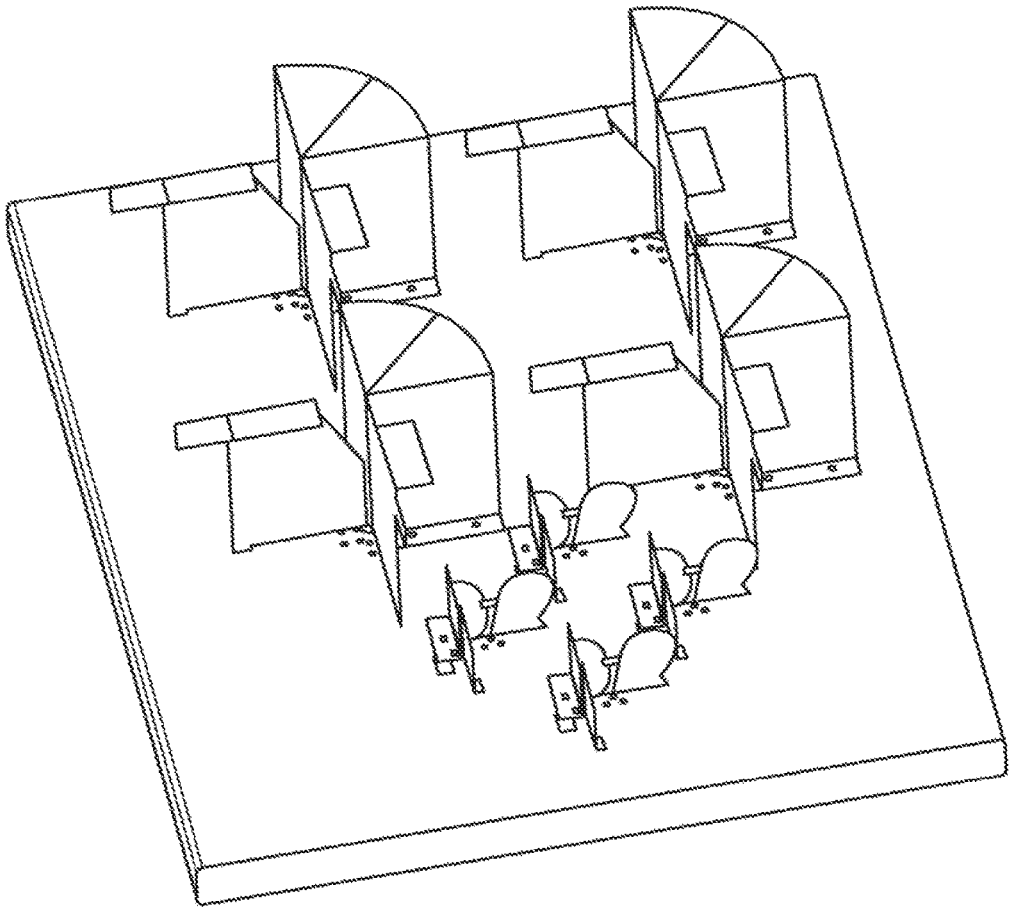
Figure 2:
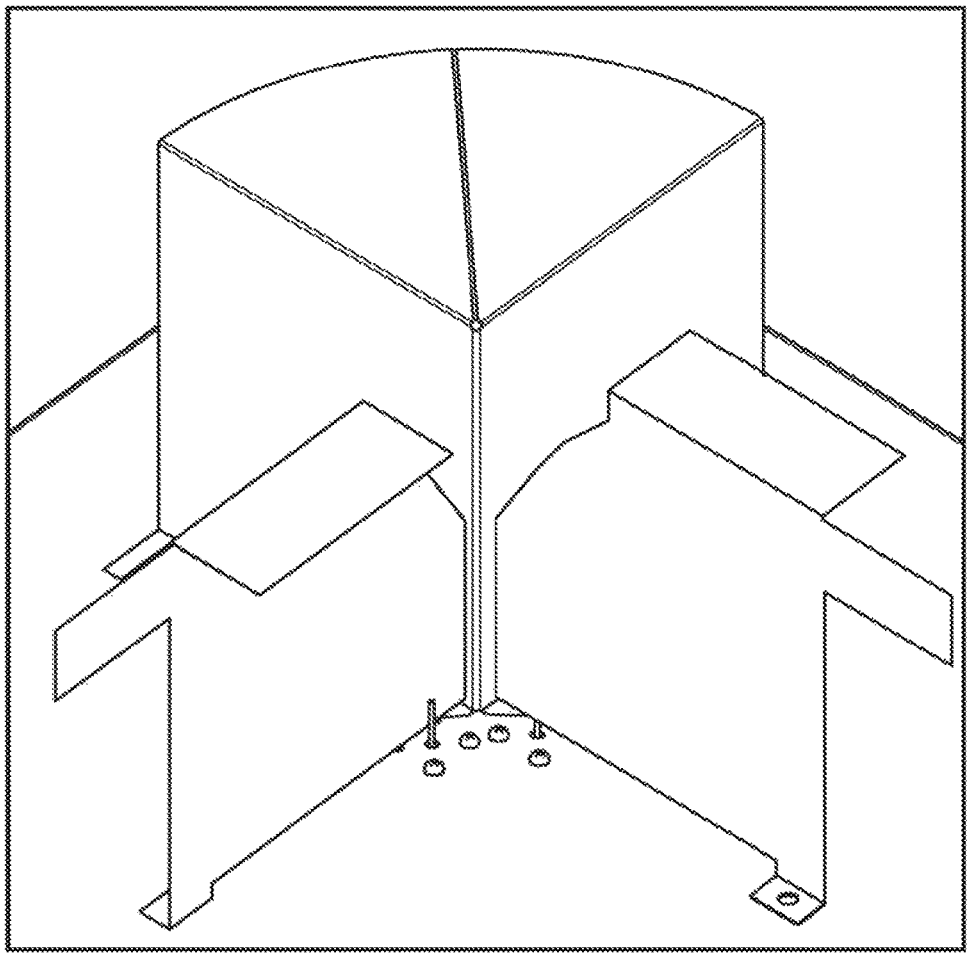
Figure 3:
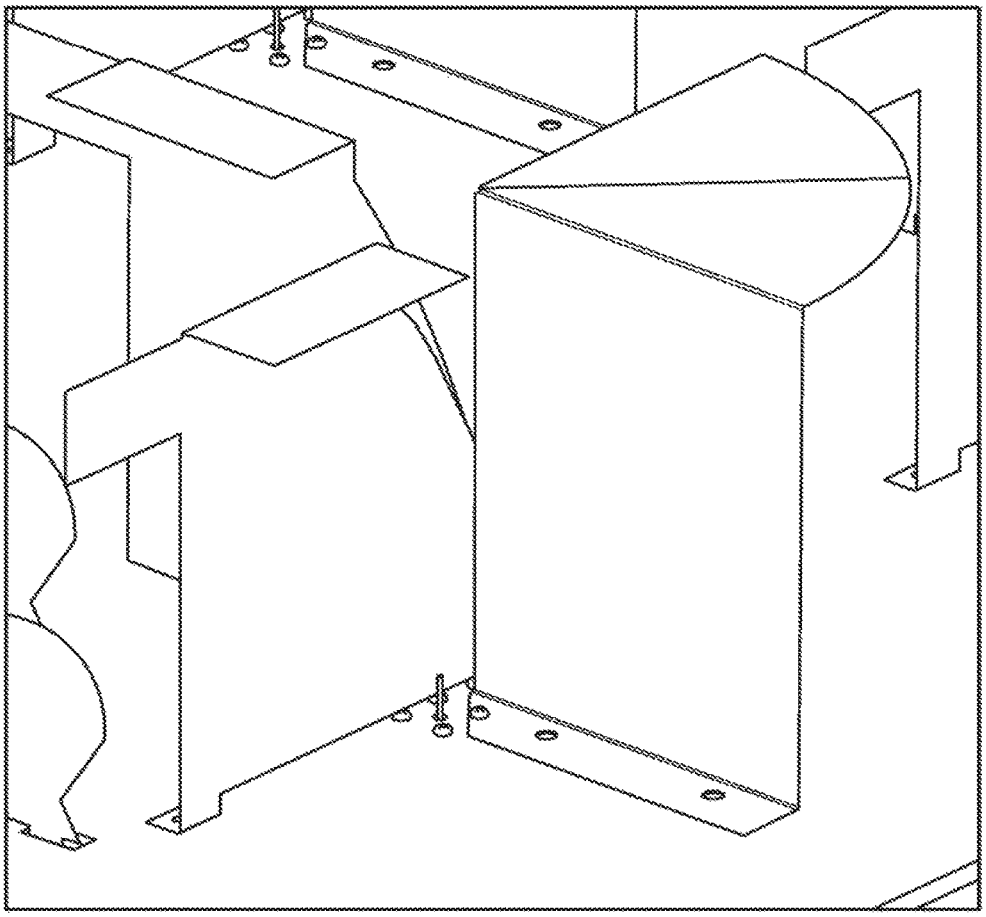
Figure 4:
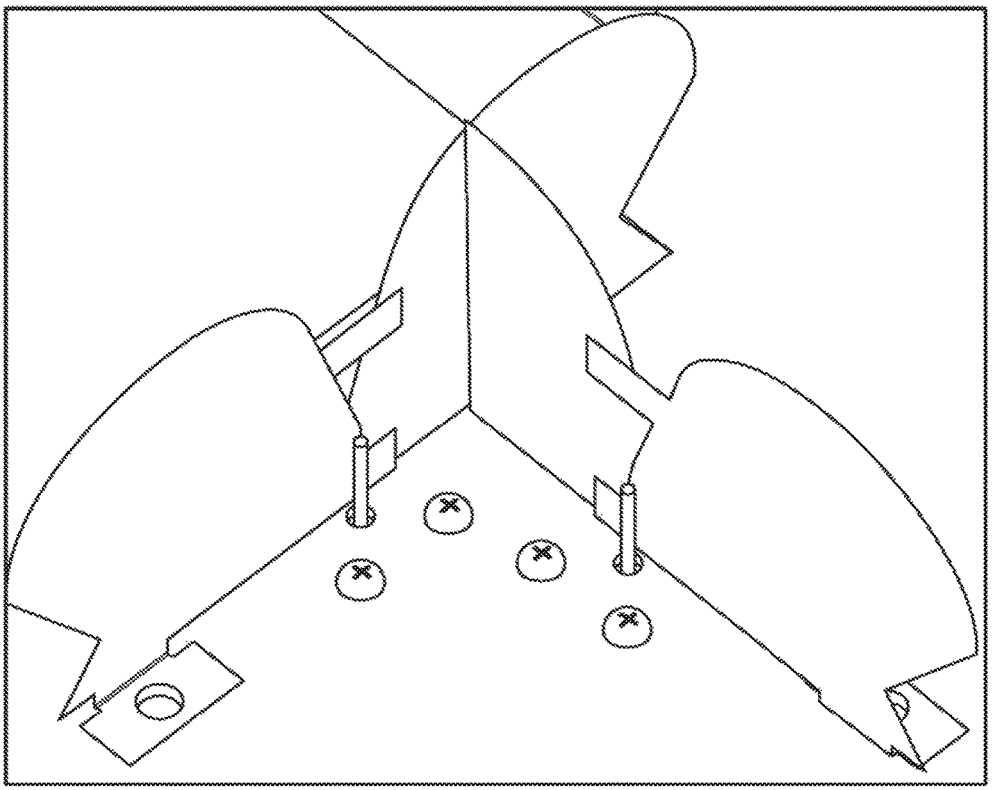
Figure 5:
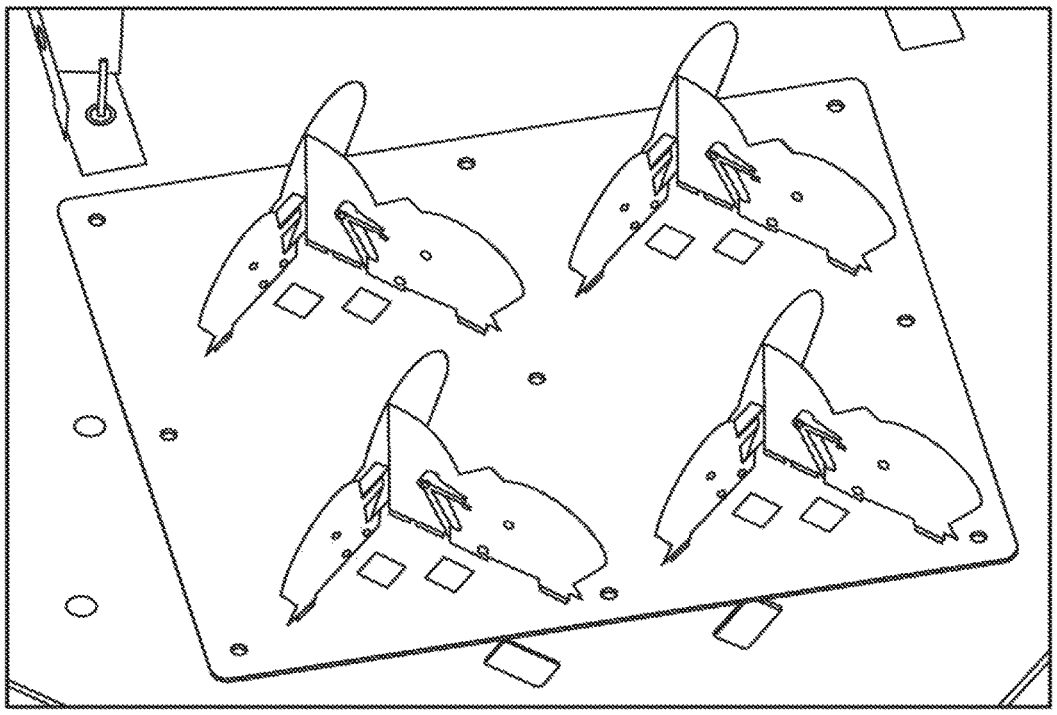
FIG. 5 illustrates an array of elements as described in FIG. 4. In this illustration all four pairs of antenna elements are directly connected to a ground plane, which is in turn capacitively coupled to a second lager ground plane.
Figure 6:
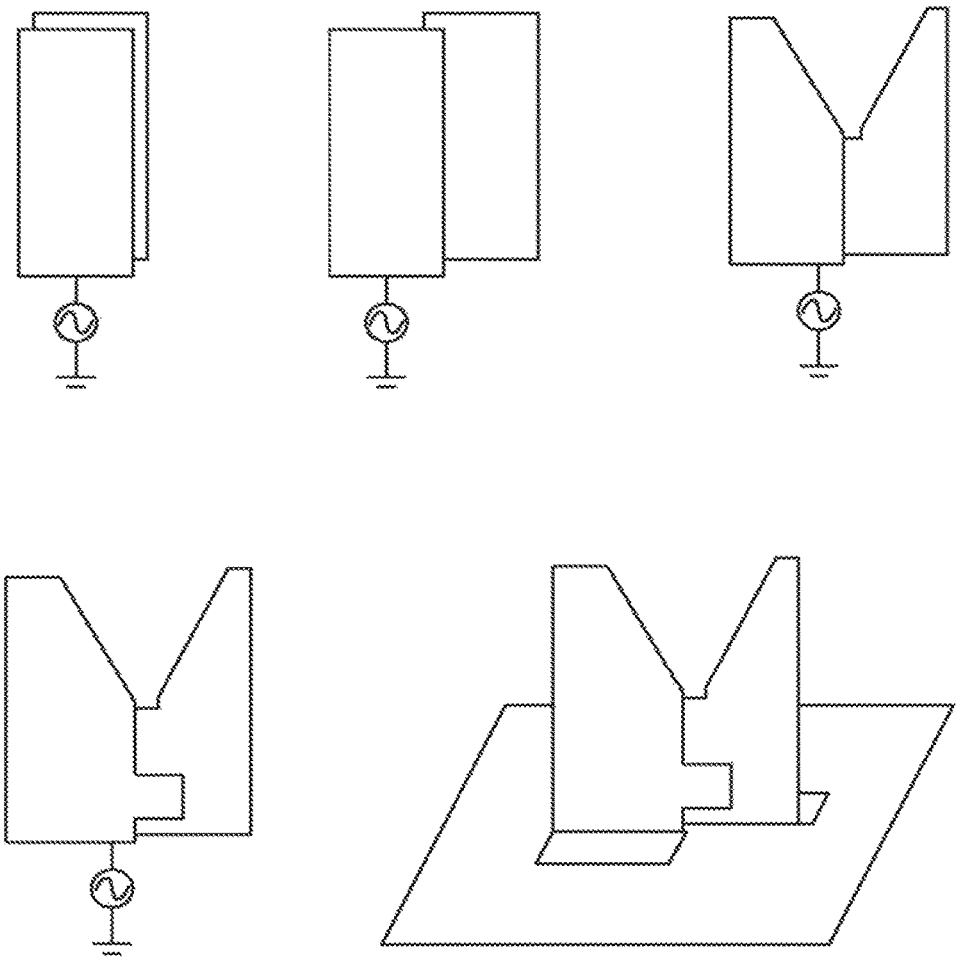
FIG. 6 illustrates a design process for developing a wide band antenna for array applications where the beamwidth remains constant over wide frequency ranges. The steps to transition from a parallel plate set of conductors to a capacitively coupled pairs of taper elements is shown.
Figure 7:
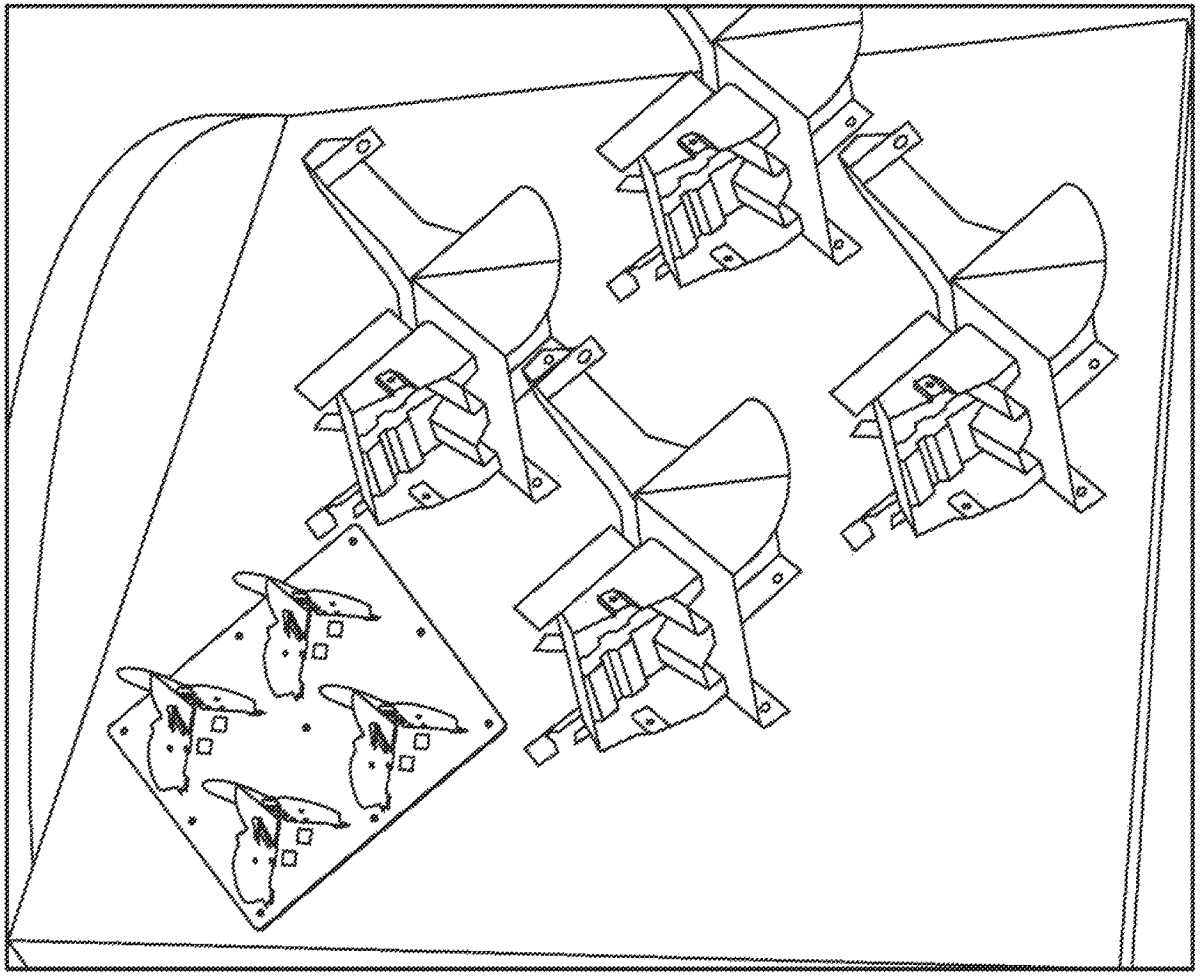
FIG. 7 illustrates a prototype array that has been built and tested utilizing the wideband beamwidth techniques described in this application.
Figure 8:
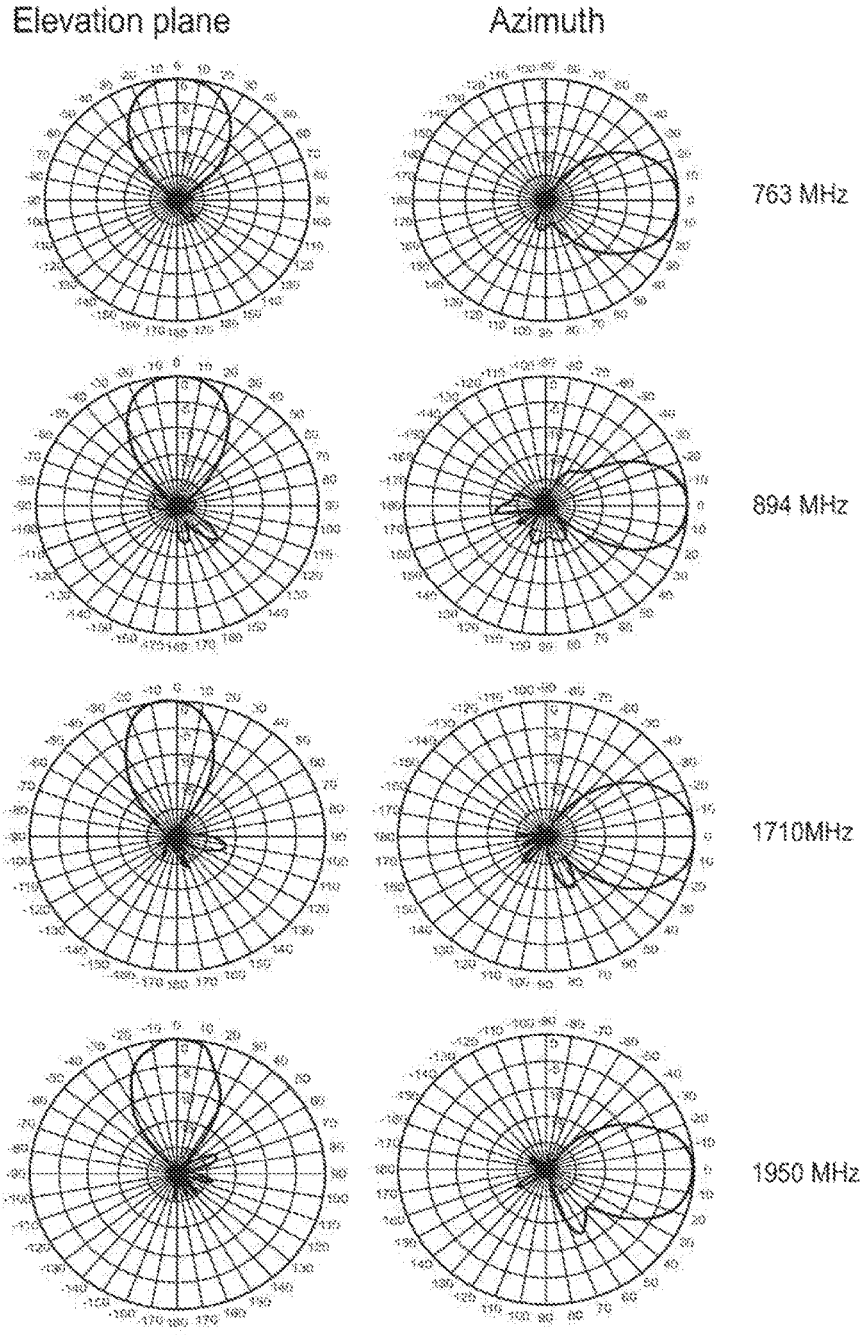
FIG. 8 illustrates measured radiation patterns for a dual band array that covers the 700 to 894 MHz and 1710 to 2170 MHz frequency ranges. The four frequencies shown show that there is negligible changes in 3 dB beamwidth in both elevation and azimuth planes.

The invention claimed is:

1. An antenna comprising:

a first conductor formed in a predominantly planar fashion; a portion of the first conductor is positioned in close proximity to a ground plane, with this portion capacitively coupled to said ground plane to provide a point of low impedance;

a second conductor positioned in proximity to the first conductor;

the first conductor is fashioned such that a section of the first conductor can be positioned close to the second conductor; additional portions of the first conductor are tapered to increase the distance between portions of the first and second conductors;

a connector or transmission line attached to the ground plane such that the ground reference of the connector or transmission line is attached to the ground plane; the signal connection of the connector or transmission line is connected to the first conductor, and is used to provide a signal to or receive a signal from the first conductor;

wherein a third conductor is positioned in proximity to the first conductor and the second conductor and the third conductor is wedge-shaped.

2. The antenna of claim 1, wherein the first conductor comprises a top portion oriented parallel to the ground plane.

3. The antenna of claim 2, wherein the top portion of the first conductor is capacitively coupled to the ground plane to decrease a frequency response of the antenna.

4. The antenna of claim 1, wherein the second conductor comprises a top portion oriented parallel to the ground plane.

5. The antenna of claim 4 wherein the top portion of the second conductor is capacitively coupled to the ground plane to decrease a frequency response of the antenna.

6. The antenna of claim 1, wherein the second conductor is fed from a second connector or transmission line that is separate from the connector or transmission line connected to the first conductor.

7. The antenna of claim 1, wherein the third conductor is oriented perpendicular to the first conductor and the second conductor.

8. The antenna of claim 1, wherein the third conductor comprises a planar portion, wherein the first or second conductor is coupled to the planar portion.

9. The antenna of claim 1, wherein the third conductor acts as a counterpoise conductor to the first conductor and the second conductor.

10. The antenna of claim 1, wherein the third conductor acts as a ground section for the first conductor and the second conductor.

11. The antenna of claim 1, wherein the third conductor comprises an about 90 degree angle.

12. The antenna of claim 1, wherein the ground reference of the connector or transmission line is capacitively coupled to the ground plane.

13. The antenna of claim 1, wherein the signal connection of the connector or transmission line is capacitively coupled to the first conductor.

14. The antenna of claim 1, wherein a coupling region is formed between the first or second conductor and the third conductor.

15. The antenna of claim 1, wherein a slot region is formed between the bottom of the first or second conductor and the ground plane, wherein the slot region is configured to alter a frequency response of the antenna.

16. The antenna of claim 1, wherein the antenna is configured to cover a frequency band of about 700 MHz to about 960 MHz.

17. The antenna of claim 1, wherein the antenna is configured to cover a frequency band of about 1700 MHz to about 2700 MHz.

18. The antenna of claim 1, wherein each of the connections in the antenna comprises a capacitive coupling such that there are no conducting contacts on the antenna.

19. A multi-antenna array comprising a plurality of the antennas of claim 1, wherein each of the plurality of antennas is co-located on the same ground plane.

20. The multi-antenna array of claim 19, comprising a pair of pluralities of antennas, wherein each of the antennas in a first plurality of antennas is perpendicular to each of the antennas in a second plurality of antennas, wherein the first plurality of antennas and the second plurality of antennas are fed from separate feed networks.

* * * * *